US009022468B2

(12) United States Patent
Shalaby et al.

(10) Patent No.: US 9,022,468 B2
(45) Date of Patent: May 5, 2015

(54) INTERACTIVE SITTING SYSTEM

(75) Inventors: Ehab Shalaby, Hagerstown, MD (US); Cherif Hassan, Newark, CA (US)

(73) Assignees: Cherif Atia Algreatly, Palo Alto, CA (US); Ehab Shalaby, Hagerstown, MD (US)

( * ) Notice: Subject to any disclaimer, the term of this patent is extended or adjusted under 35 U.S.C. 154(b) by 0 days.

(21) Appl. No.: 13/479,199

(22) Filed: May 23, 2012

(65) Prior Publication Data

US 2013/0313871 A1 Nov. 28, 2013

(51) Int. Cl.
*A61B 5/103* (2006.01)
*A47C 31/12* (2006.01)

(52) U.S. Cl.
CPC ..... *A47C 31/126* (2013.01)

(58) Field of Classification Search
CPC ..... G08B 23/00; G08B 25/00; G08B 21/00; F01N 1/08; G01N 3/24; A61B 5/00; A61B 5/11
USPC ..... 297/217.2, 217.3; 600/587, 594
See application file for complete search history.

(56) References Cited

U.S. PATENT DOCUMENTS

| | | | | |
|---|---|---|---|---|
| 5,042,504 | A * | 8/1991 | Huberti | 600/592 |
| 6,030,351 | A * | 2/2000 | Schmidt et al. | 600/592 |
| 7,109,872 | B2 * | 9/2006 | Balaban et al. | 340/573.7 |
| 7,407,029 | B2 * | 8/2008 | Breed et al. | 180/274 |
| 7,472,956 | B2 * | 1/2009 | Makhsous et al. | 297/284.9 |
| 7,918,142 | B1 * | 4/2011 | Tarler | 73/841 |
| 8,384,551 | B2 * | 2/2013 | Ross et al. | 340/573.7 |
| 2008/0077020 | A1 * | 3/2008 | Young et al. | 600/484 |
| 2009/0058661 | A1 * | 3/2009 | Gleckler et al. | 340/573.7 |
| 2011/0275939 | A1 * | 11/2011 | Walsh et al. | 600/473 |

* cited by examiner

*Primary Examiner* — Sarah B McPartlin
(74) *Attorney, Agent, or Firm* — Lowe Hauptman & Ham, LLP

(57) ABSTRACT

The present invention introduces an interactive sitting system that measures and analyzes the forces exerted on a human body during contact with other objects such as a seat to provide a feedback for the user to assess the risk of such forces on the spine and the skin to avoid complications of abnormal or prolonged sitting.

20 Claims, 5 Drawing Sheets

INTERACTIVE SITTING SYSTEM

BACKGROUND

According to the National Institute of Health (NIH), back pain is the second most common neurological ailment in the United States. Americans spend at least $50 billion each year on low back pain and its complications. It is the most common cause of job-related disability and a leading contributor to missed work. Prolonged sitting is a significant cause of skin breakdown, decubitus ulcers and spine deformities in wheelchair bound patients.

SUMMARY

The present invention introduces a sensitive pad that can be placed on any seat to measure the dynamic forces exerted on different parts of the back and buttocks during sitting to generate a user's personal report describing his/her habits during prolonged sitting that might create spine or skin problems. The sensitive pad is a portable device that can also be used when driving a car, sitting at work/home, or using a wheelchair giving an immediate feedback that helps the user to improve his/her sitting habits.

The sensitive pad can be programmed to suit everyone's circumstances such as age, medical condition, or the activity that is performed during sitting. It also helps the user to evaluate the seat s/he is using and its compatibility with his/her back. Generally, the sensitive pad is an important device for computer users, young students, car drivers, and designers. It is an important tool for spine physicians, pain management doctors, chiropractors and physical therapists to help diagnose and treat their back pain patients.

The sensitive pad is of particular importance for disabled people such as paraplegic, elderly, and wheelchair users who lack skin sensation or mental alertness to help them avoid skin breakdown and ulcers. Another important use of the sensitive pad is to detect insurance fraud in back pain malingering. Moreover, the sensitive pad can accurately record in great details the sequence of forces exerted on the user's back during motor vehicle accidents which enable physicians to better diagnose and treat spine injuries.

In summary, the sensitive pad is a powerful technology that assists physicians diagnose and treat low back pain. It helps individual users avoid complications due to prolonged sitting and maintain healthy back and skin. It enables the chairs industry to create healthy parameters and standards for chair design and manufacturing.

DETAILED DESCRIPTION

Figure 1:
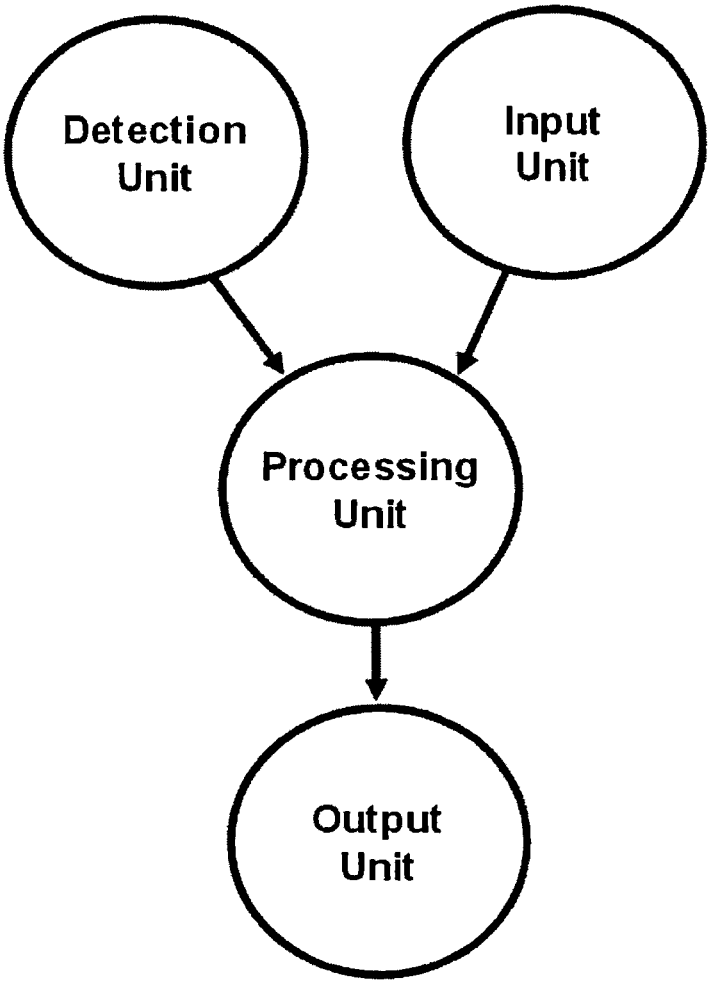
FIG. 1 is a flowchart illustrating the main components of the present invention.

The present invention introduces an interactive sitting system that measures and analyzes the forces exerted on a body during its contact with other object to provide a certain feedback for the user. As illustrated in FIG. 1 said interactive sitting system is comprised of; a detection unit, an input unit, a processing unit, and output unit.

The detection unit senses, collects, and generates initial signals representing the amount, durations, and directions of said forces exerted on said body, where said detection unit can be placed between said body and said other object.

Figure 2:
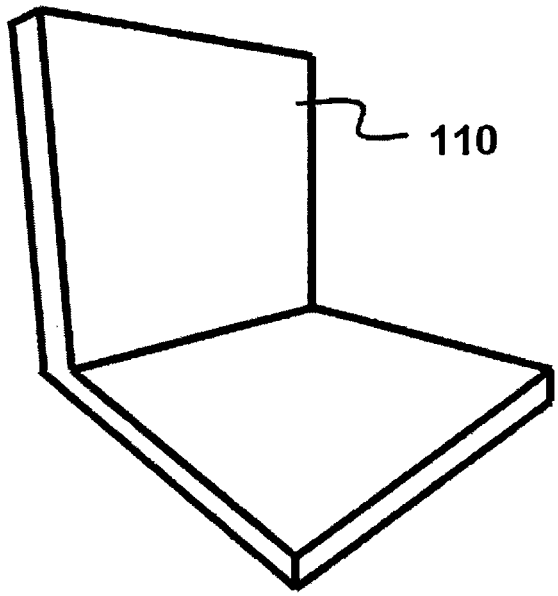
FIG. 2 is an example of the detection unit of the present invention.

For example, FIG. 2 illustrates a detection unit in the form of a sensitive pad 110 that looks like a seat cushion that can be placed on any seat to be located between the user and the seat. The sensitive pad is comprised of a plurality of sensors that are placed along the sensitive pad to detect the position, amount, duration, and direction of the compression forces and the shear forces that are exerted on the sensitive pad. Said exerted forces will be influenced by the user's body characters, the user activity during sitting, and the seat specifications.

Figure 3:
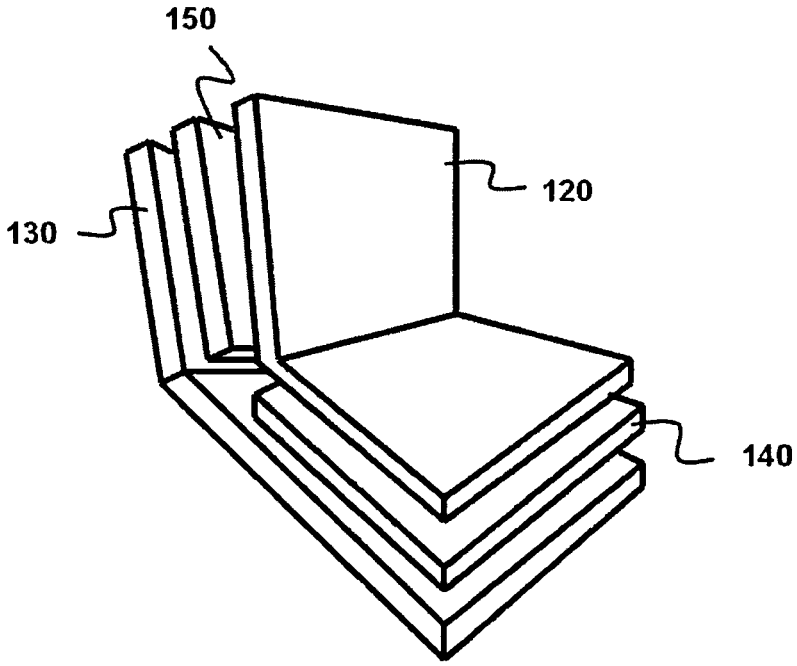
FIG. 3 is an example of the interior components of the detection unit.

FIG. 3 illustrated the interior components of the sensitive pad where as shown in the figure the sensitive pad is comprised of a top layer 120 of protective sheet, a bottom layer 130 of protective sheet, and a middle layer which is comprised of a first sheet of sensors 140 and a second sheet of sensors 150. The first sheet of sensors is located on the seat area of the seat, while the second sheet of sensors is located on the back rest area of the seat.

Figure 4:
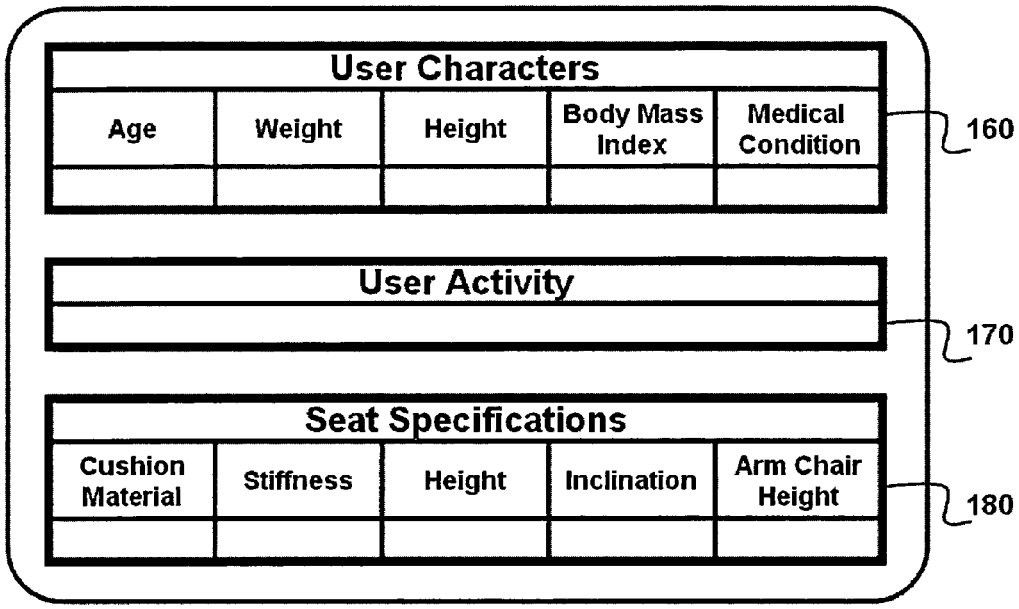
FIG. 4 is an example of the input unit of the present invention.

FIG. 4 illustrates an example of an input unit in the form of a selection menu that appears on the computer display comprising of three part, the first part 160 presents the user's characters, the second part presents the user activity, and the third part presents the seat specifications. The user's characters can include the user's age, weight, height, body mass index, medical condition, and the like. The user activity can include many alternatives such as using the computer, driving a car, performing office work, wheelchair bound, or the like. The chair specifications can include the chair cushion material, stiffness, height, inclination, arm chair height, or the like.

Figure 5:
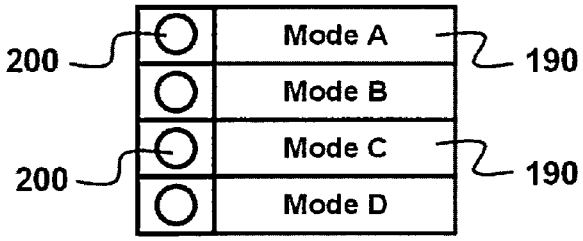
FIG. 5 is another example of the input unit of the present invention.

FIG. 5 illustrates another example of the input unit in the form of a selection mode where the user can select one of them. As shown in the figure the selection mode is comprised of a number of different modes 190 where each one of them has a unique name where a press button 200 is located beside each unique name to be pressed by the user's finger to activate the selected mode. Each mode represents a unique type of users that have different body characters. For example, mode "A" represents a category of body weight ranging from 40 to 80, mode "B" represents a category of body weight ranging from 81 to 120, mode "C" represents a category of body weight ranging from 121 to 180, mode "D" represents a category of body weight ranging from 181 to 220, and mode "A" represents a category of body weight ranging above 220.

The processing unit can be a microprocessor that can be located inside the sensitive pad of FIG. 2. The processing unit performs specific analysis based on an assessment program that can be provided by the manufacture of the present invention. Analyzing the data of the detection unit and the input unit enables providing the output unit with the result of this analysis.

The output unit can be an audio system that provides the user with a voice or sound representing certain information. It can be also a visual system that provides the user with visual signs representing certain information. It can be a sensory system that provides the user with vibratory responses or movement representing certain information. It can also provide an electrical signal that can be interpreted as a mechanical adjustment for power chairs.

Figure 6:
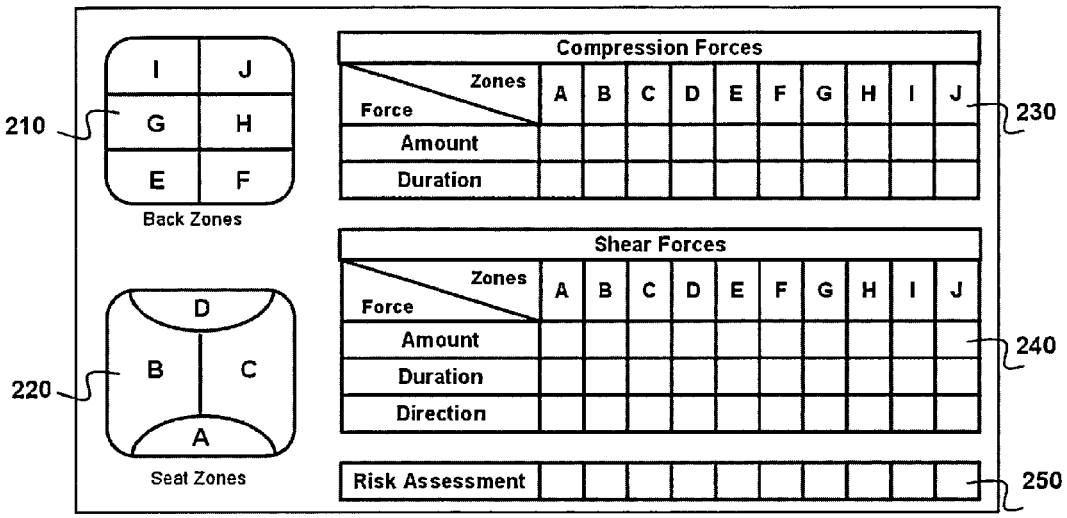
FIG. 6 is an example of the output unit of the present invention in the form of a digital report.

The output unit can be a digital display that provides the user with digital information or graphical illustrations. For example, FIG. 6 illustrates an example of a digital report comprised of; a zoning representation for the seat pad 220 divided into four zones A, B, C, and D, a zoning representation for the back pad 230 divided into six zones E, F, G, H, I, and J, a first table 240 indicating the amount and duration of the compression forces that are exerted on the different zones, a second table indicating the amount, duration, and direction of the shear force that are exerted on the different zones, and a third table indicating the risk analysis that may indicate numeral values, colors, or the like representing said risk analysis.

Figure 7:
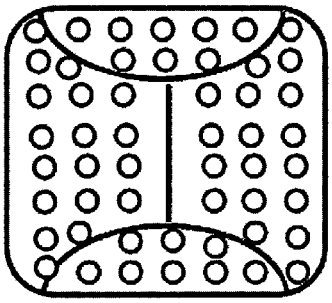
FIG. 7 is a number of sensors positioned on a sensitive pad.
Figure 8:
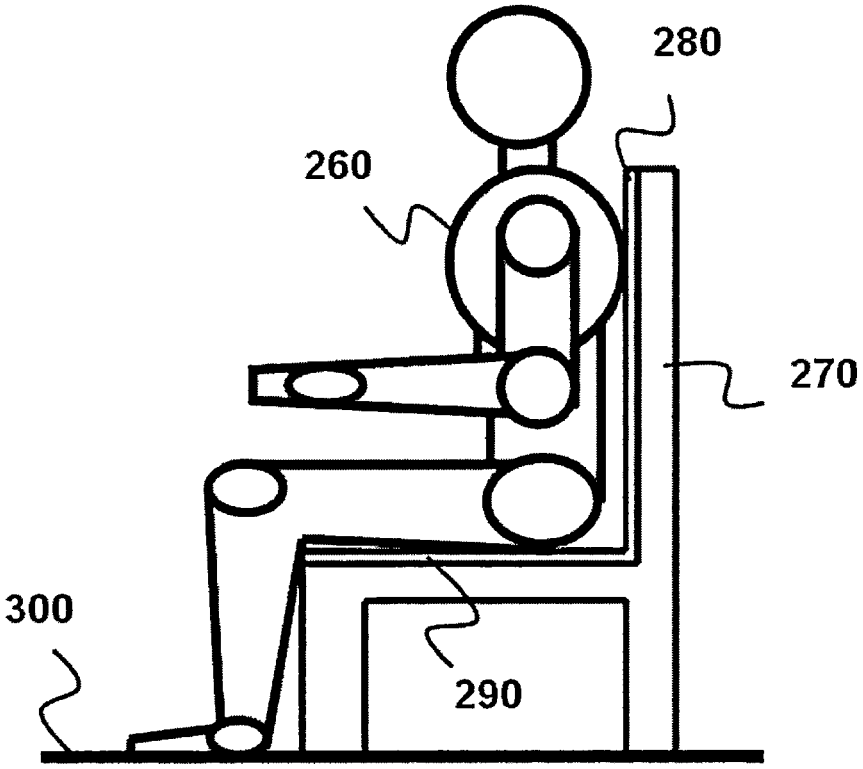
FIG. 8 is another example of the output unit of the present invention in the form of a 3D simulation.

FIG. 7 illustrates an example of an output unit in the form of a display presenting a graphical illustration such as a 3D simulation showing the movement of the user of the present invention 260 while sitting on the seat 270 where a first sensitive pad 280 is placed between the user's buttocks and the seat, and a second sensitive pad 290 is placed between the user's back and the back rest of the seat. The horizontal line 300 represents the floor that supports the seat.

The main advantages of the present invention is utilizing an existing hardware technology that is simple and straightforward which easily and inexpensively carries out the present invention of interactive sitting system as will be described subsequently.

For example, the sensitive pad is comprised of a plurality of sensors that detect the force exerted from the user on the seat. Said sensors can be force sensors that are commercially available in the market such as the flexible sensors or the digital sensors. The capacitive sensors can be used instead of the force sensors to detect the compression force and its duration and positions on the sensitive pad. Also the photocromic sensors that change due to the pressure or the user's temperature can be used instead of the force sensors. The pressure sensors can be a plurality of chambers that are attached to each other and filled with gas or liquid to sense the pressure in each chamber.

It is important to note that the seat area and the back area of the sensitive pad are divided into a number of zones as shown in FIG. 6. Each one of these number of zones includes a plurality of sensors that collect the data of the force exerted on this specific zone. The zones of FIG. 6 are just example of a variety of different zones that can divide the sensitive pad according to the application need. FIG. 7 illustrates an example of positioning a number of sensors along the sensitive pad.

The input unit can be a detailed selection menu FIG. 4 or just a limited preset selection mode program as illustrated in FIG. 5. However, the selection menu can include other information related to the user characters, user activity, and seat specifications, in addition to, other fields such as ambient temperature, floor leveling, or the like.

The microprocessor can be a computer system that is connected to the present invention by a wired or wireless connection. The present invention can also utilize the computer system of a mobile phone to receive, display, and/or send information from and to the sensitive pad. Sending information to the sensitive pad enables modifying the assessment program wirelessly in case of there are specific changes such as the medical condition of the user.

The system program can provide the user with useful information or instructions related to his/her sitting. That can happen if the user exceeded a certain duration or force on the sensors of a specific zone, or the total area of the sensitive pad. Also if the zones of the back area remain without acting forces for a specific period of time that means the user is not supporting his/her back on the back rest of the seat.

The output unit can be audible information in the form of voice or sound. It can be a visual output in the form of light, colors, or the like. It can also be sensory output such as vibrations, pressures, or the like. It can be electrical signals that can be interpreted into a mechanical movement for power chairs. It can be a digital display that presents digital information, graphs, pictures, 3D models, animation, or the like.

The invention claimed is:

1. An interactive sitting system that measures, analyzes, and provides a feedback on the forces exerted on a body when the body is in contact with an object wherein the interactive sitting system is comprised of:

a detection unit located between the body and the object to sense, collect and generate an initial signal representing the magnitudes, durations and directions of the forces;

an input unit that receives a first data representing the characteristics of the body and a second data representing the characteristics of the object to provide the first data and the second data to a processing unit;

a processing unit that receives and analyzes the initial signal, the first data and the second data according to an assessment program to generate an ultimate data representing the feedback; and an output unit that receives and converts the ultimate data into a feedback.

2. The interactive sitting system of claim 1 wherein the detection unit is comprised of one or more sensors that detect the pressure and directions of the forces.

3. The interactive sitting system of claim 1 wherein the input unit is a digital display equipped with one or more input tools such as a touchscreen, keyboard, microphone, or camera.

4. The interactive sitting system of claim 1 wherein the body is a human body and the characteristics of the body represent the gender, age, weight, height, body mass index, apparent deformities or medical condition of the human body.

5. The interactive sitting system of claim 1 wherein the body is a human body and the characteristics of the body represent the body habits during the contact with the object.

6. The interactive sitting system of claim 1 wherein the characteristics of the object represent the material, stiffness, dimensions or shape of the object.

7. The interactive sitting system of claim 1 wherein the processing unit is a microprocessor.

8. The interactive sitting system of claim 1 wherein the processing unit is a computer system of a mobile phone, tablet, or computer.

9. The interactive sitting system of claim 1 wherein the assessment program includes algorithm, formulas, or rules to analyze the initial signal, the first data and the second data relative to each other.

10. The interactive sitting system of claim 1 wherein the output unit is a visual system in the form of a digital screen, and the feedback is colors, lights, text, drawings, 3D models, or animation presented on the digital screen.

11. The interactive sitting system of claim 1 wherein the output unit is an audio system in the form of a speaker medium and the feedback is vocal information, sound, alarm or music generated by the audio system.

12. The interactive sitting system of claim 1 wherein the output unit is a tactile feedback system attached to the body, and the feedback is vibrations, motions or forces generated by the tactile feedback system.

13. The interactive sitting system of claim 1 wherein the output unit is a mechanical system that can adjust the stiffness, dimensions or shape of the object, and the feedback is a mechanical adjustment to the stiffness, the dimensions, or the shape.

14. The interactive sitting system of claim 1 wherein the object is a chair and the feedback is information representing the analysis of the healthy standards of the chair relative to the body.

15. The interactive sitting system of claim 1 wherein the feedback represents the risk analysis of the forces exerted on the body.

16. The interactive sitting system of claim 1 wherein the body is a human body and the object is a seat, chair, wheelchair, or car seat.

17. The interactive sitting system of claim 1 wherein the body is not a human body.

18. The interactive sitting system of claim 2 wherein the sensors are electronic, mechanical, chemical, or biological sensors.

19. The interactive sitting system of claim 2 wherein the sensors are attached to the object or located inside the object.

20. The interactive sitting system of claim 2 wherein the sensors are a plurality of chambers that are filled with gas or liquid to sense the pressure applied on the chambers.

* * * * *